US007844192B2

(12) United States Patent
Williams et al.

(10) Patent No.: US 7,844,192 B2
(45) Date of Patent: Nov. 30, 2010

(54) APPARATUS AND METHOD FOR ADJUSTING FUSER NIP WIDTH

(75) Inventors: Stephen Bradley Williams, Marion, NY (US); Paul M. Fromm, Rochester, NY (US); William A. Burton, Fairport, NY (US); Steven Matthew Russel, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 152 days.

(21) Appl. No.: 12/356,101

(22) Filed: Jan. 20, 2009

(65) Prior Publication Data

US 2010/0183326 A1 Jul. 22, 2010

(51) Int. Cl.
*G03G 15/20* (2006.01)

(52) U.S. Cl. ..... 399/67; 399/328

(58) Field of Classification Search ..... 399/33, 399/67, 68, 69, 328

See application file for complete search history.

(56) References Cited

U.S. PATENT DOCUMENTS 4,972,232 A 11/1990 Hoover et al.
5,887,236 A * 3/1999 Hirao et al. ..... 399/328 X
5,956,543 A * 9/1999 Aslam et al. ..... 399/67 X
6,253,046 B1 * 6/2001 Horrall et al. ..... 399/328 X
6,799,000 B2 * 9/2004 Aslam et al. ..... 399/67 X
6,819,890 B1 * 11/2004 Bott et al. ..... 399/67
7,113,717 B2 * 9/2006 Bott et al. ..... 399/67
7,298,985 B2 * 11/2007 Nihonyanagi et al. ..... 399/69
2008/0193176 A1 8/2008 Roof

* cited by examiner

*Primary Examiner*—Sandra L Brase
(74) *Attorney, Agent, or Firm*—Matthew C. Loppnow; Prass LLP

(57) ABSTRACT

An apparatus (100) and method (300) that adjusts a fuser nip width in an apparatus that can include a fuser member having a fuser nip configured to fuse an image on media is disclosed. The method can include feeding (320) a media sheet in a media sheet travel direction through the fuser nip. The method can also include sensing (330) a media sheet exit temperature of the media sheet after the media sheet exits the fuser nip. The method can also include adjusting (340) a fuser member nip width according to the sensed media sheet exit temperature, where the fuser nip width is substantially parallel to the media sheet travel direction.

20 Claims, 5 Drawing Sheets

APPARATUS AND METHOD FOR ADJUSTING FUSER NIP WIDTH

BACKGROUND

Disclosed herein is an apparatus and method that adjusts a fuser nip width for a fuser, such as a fuser used in xerographic or other forms of printing.

Presently, devices such as printers, copiers, multi-function devices, and other devices produce images on media, such as on sheets, paper, transparencies, plastic, cardboard, or other media. These devices mark a media sheet with a latent image using marking material, such as toner, ink jet ink, solid ink jet ink, or other marking materials. The marked media sheet is then fed through a fuser nip that provides pressure and/or heat to the marked media sheet to fuse the latent image on the media sheet. It is difficult to accurately control the settings of the fuser nip. These settings can include pressure, nip width, temperature, fuser speed, and other settings. These settings influence the efficiency of fusing the latent image on the media. Various factors such as fuser roll hardness, which changes over time, variations in fuser nip settings, temperature control device tolerances, and paper weight and size all affect a device's capacity to provide the optimal amount of energy required to accurately fuse an image with consistent results. For example, a fuser should apply uniform heat and pressure to a media sheet across the width and length of the media sheet. The amount of heat and pressure is based on media sheet type, media sheet size, toner density, and other factors.

If the fuser nip width and temperature are not uniform across the length of the fuser, the heat input to the paper will not be uniform across the width of the paper. This results in a non uniform fusing process, which results in image defects and a poor fixed image. Also, if the fuser nip is not uniform across the length of the fuser, one end of the fuser will receive extensive loading, which causes extensive edge wear on that end. This results in shortened fuser roll life from edge wear. Furthermore, a fuser roll or corresponding pressure roll should be relatively soft and deformable to create a sufficient nip width. However, the roll can harden over time. As the roll hardens, the fuser nip width gets smaller, which reduces fusing efficiency.

Thus, there is a need for an apparatus and method that adjusts a fuser nip width.

SUMMARY

An apparatus and method that adjusts a fuser nip width in an apparatus that can include a fuser member having a fuser nip configured to fuse an image on media is disclosed. The method can include feeding a media sheet in a media sheet travel direction through the fuser nip. The method can also include sensing a media sheet exit temperature of the media sheet after the media sheet exits the fuser nip. The method can also include adjusting a fuser member nip width according to the sensed media sheet exit temperature, where the fuser nip width is substantially parallel to the media sheet travel direction.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include a method that adjusts a fuser nip width in an apparatus that can include a fuser member having a fuser nip configured to fuse an image on media. The method can include feeding a media sheet in a media sheet travel direction through the fuser nip. The method can also include sensing a media sheet exit temperature of the media sheet after the media sheet exits the fuser nip. The method can also include adjusting a fuser member nip width according to the sensed media sheet exit temperature, where the fuser nip width is substantially parallel to the media sheet travel direction.

The embodiments further include an apparatus that adjusts a fuser nip width. The apparatus can include a media transport configured to transport a media sheet. The apparatus can also include a fuser member coupled to the media transport, the fuser member having a fuser nip configured to fuse an image on media. The apparatus can also include an exit sensor coupled in proximity to the fuser member, such as in proximity to the fuser nip, the exit sensor configured to sense an exit temperature of the media sheet after the media sheet exits the fuser nip. The apparatus can also include a controller coupled to the exit sensor and coupled to the fuser member, the controller configured to adjust a fuser member nip width.

The embodiments include a method that adjusts a fuser nip width in an apparatus that can include a fuser member having a fuser nip configured to fuse an image on media. The method can include feeding a media sheet in a media sheet travel direction through the fuser nip. The method can also include exerting pressure on the media sheet using the fuser nip. The method can also include sensing a media sheet exit temperature of the media sheet after the media sheet exits the fuser nip. The method can also include adjusting a fuser nip width according to the sensed media sheet exit temperature, where the fuser nip width is substantially parallel to the media sheet travel direction.

Figure 1:
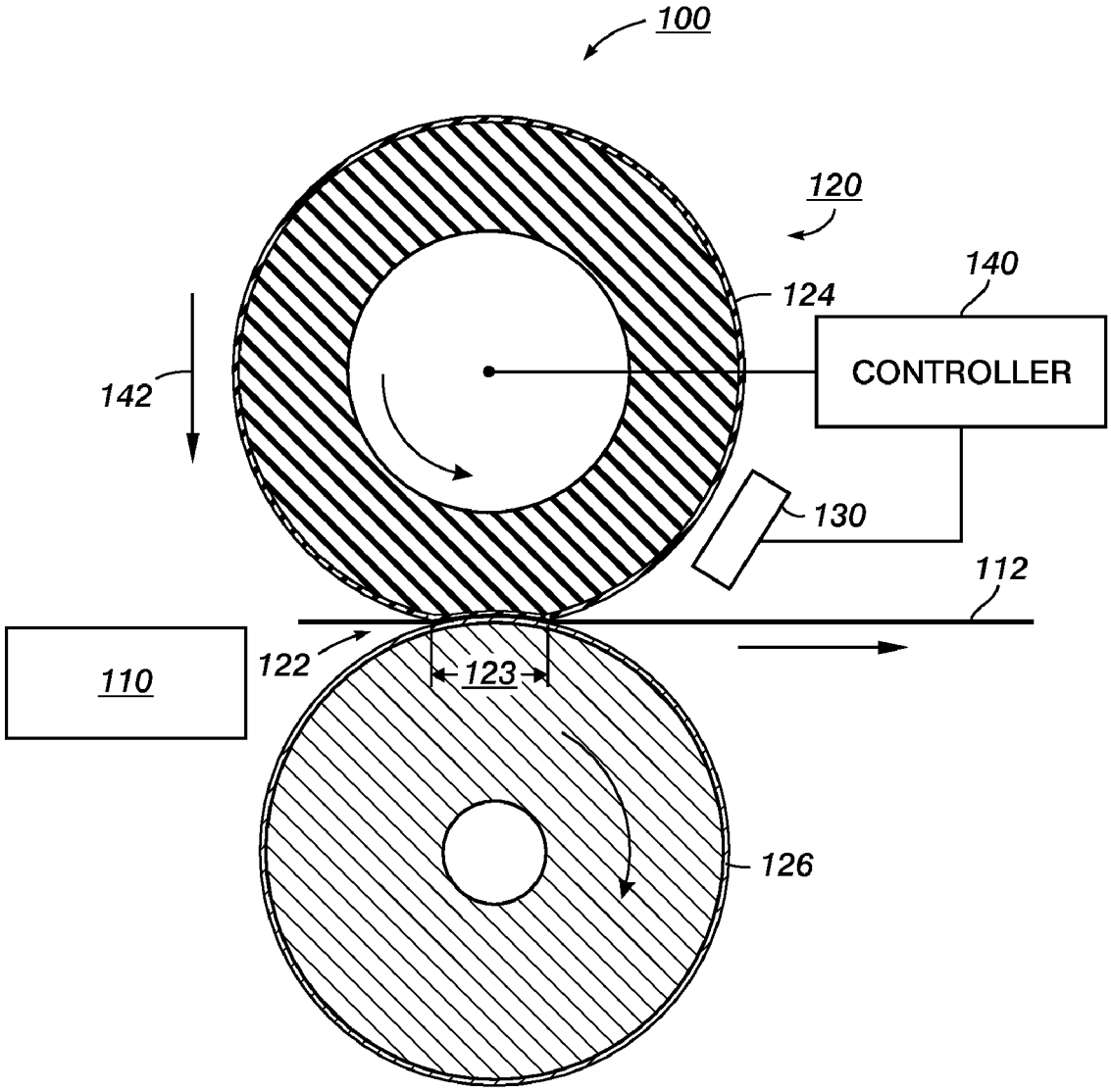
FIG. 1 is an exemplary side view illustration of an apparatus.

FIG. 1 is an exemplary side view illustration of an apparatus 100. The apparatus 100 may be a document feeder, a printer, a scanner, a multifunction media device, a xerographic machine, or any other device that transports media. The apparatus 100 can include a media transport 110 configured to transport media 112. The apparatus 100 can also include a fuser member 120 coupled to the media transport, where the fuser member 120 can have a fuser nip 122 configured to fuse an image on media. The fuser member 120 can include a rotational fuser member 124 rotationally supported in the apparatus 100 and a rotational pressure member 126 rotationally supported in the apparatus 100. A rotational member may be a roll, a belt, or any other member that can be rotationally supported in the apparatus 100. The rotational pressure member 126 can be configured to exert pressure against the rotational fuser member 124 at the fuser nip 122.

The apparatus 100 can include an exit sensor 130 coupled in proximity to the fuser member 120, where the exit sensor 130 can be configured to sense an exit temperature of the media sheet 112 after the media sheet 112 exits the fuser nip 122. The exit sensor 130 can be a non-contact thermal sensor. The apparatus 100 can further include a controller 140 coupled to the exit sensor 130 and coupled to the fuser member 120, where the controller 140 can be configured to adjust fuser member settings, such as a fuser nip width 123, according to the sensed exit temperature. For example, the controller 140 can adjust fuser member nip settings, such as the nip width 123 or a nip temperature and can adjust other fuser member settings, such as fuser speed. The fuser nip 122 can be dynamically adjusted through a load system by any number of dynamic means, such as variable cams, air cylinders, or other dynamic means to compensate for variations of the measured temperature from a desired or expected temperature. For example, the temperature of the media sheet 112 can increase as it passes through the fuser nip 122. One or more thermal sensors 130 can be used to measure the increase in temperature of the media sheet 112. The temperature change or increase can be used as a feedback mechanism to adjust fuser member settings.

The controller 140 can be configured to adjust fuser member settings by adjusting a fuser nip width 123 according to the sensed media sheet exit temperature, where the fuser nip width 123 is substantially parallel to the media sheet travel direction. The controller 140 can also be configured to adjust fuser member settings by adjusting at least one of a fuser member temperature and a fuser member rotational speed according to the sensed media sheet exit temperature.

One of the two members 124 and 126 can be hard and one can be soft or deformable. The fuser nip width 123 can be a function of the Durometer, such as the hardness or deformability, of the soft member. Unfortunately, the soft member may harden over time. For example, a soft roll can harden over time and the fuser nip 122 can accordingly get smaller as the roll hardens, which can reduce fusing efficiency. The apparatus 100 can use the sensed exit temperature as feedback to adjust a spring or force 142 that generates pressure between the members 124 and 126 to maintain the appropriate fuser nip width 123 to appropriately fuse the image on the media sheet 112. For example, the apparatus 100 can increase the force 142 between the members 124 and 126 if one of them gets harder. The apparatus 100 can also decrease the force 142 applied to the fuser nip 122 to create a smaller fuser nip width 123 for media and job contents that do not require as much fusing. This can increase component life, such as fuser roll life.

Figure 2:
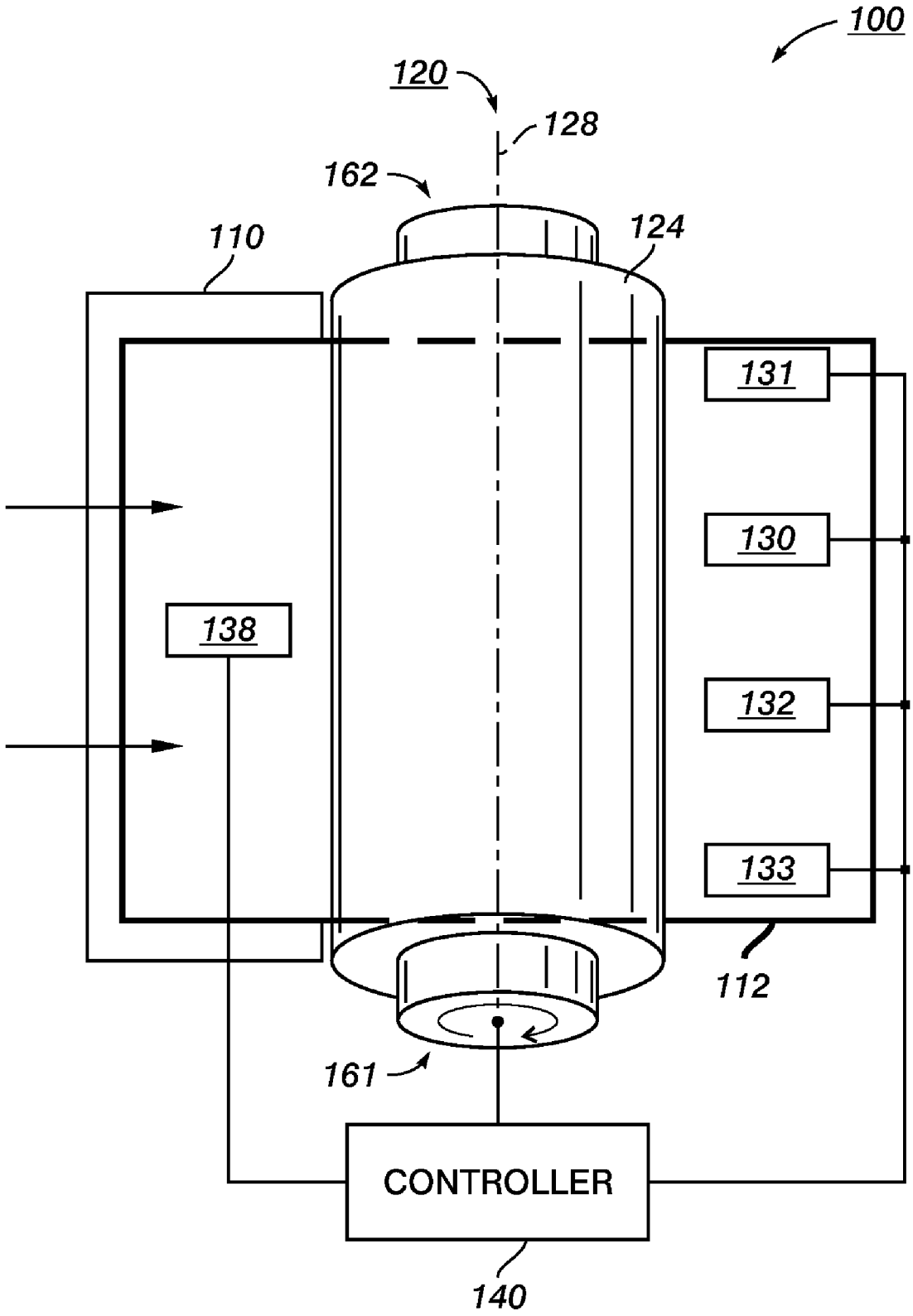
FIG. 2 is an exemplary top view illustration of an apparatus.

FIG. 2 is an exemplary top view of the apparatus 100. The exit sensor 130 can be a plurality of exit sensors 130-133 that can sense a plurality of media sheet exit temperatures across a width of the media sheet 112, where the width of the media sheet is substantially perpendicular to the media sheet travel direction. For example, the exit sensor 130 can be a single sensor 130 or can be a sensor array 130-133 spread parallel to a length rotational axis 128 of the fuser member 120 going from a first fuser member end 161 to a second fuser member end 162. The controller 140 can be configured to adjust fuser member settings according to the plurality of media sheet exit temperatures sensed by the plurality of exit sensors 130-133. For example, the controller 140 can be configured to adjust fuser member settings by adjusting a first fuser nip width at a first position, such as proximal to the exit sensor 133, along a length of the fuser 120 according to the plurality of sensed media sheet exit temperatures, where the length of the fuser is substantially perpendicular to the media sheet travel direction. The controller 140 can also be configured to adjust fuser member settings by adjusting a second fuser nip width at a second position, such as proximal to the exit sensor 131, along a length of the fuser 120 according to the plurality of sensed media sheet exit temperatures, where the second position is different from the first position. As a further example, the fuser 120 may provide different thermal input to the media sheet 112 along the length of the fuser. This may be because the fuser nip 122 has different widths along the length of the fuser or may be based on other factors. The exit sensors 130-133 can sense the different temperatures along the width of the media sheet 112 and can adjust the nip width 123 along the length of the fuser 120 to provide consistent heat to the media sheet 112. Also, a single sensor can scan along the width of the media sheet 112 to determine the temperature along the width of the media sheet 112. Additionally, one heat lamp, different heat lamps, or all heat lamps along a length of the fuser member 120 can be adjusted according to the sensed media sheet exit temperature. The intensity of the temperature of a heat lamp, the amount of time the heat lamp provides temperature, or other heat lamp factors can be adjusted according to the sensed media sheet exit temperature. However, adjusting the nip width 123 can have a more direct and immediate effect on heat transfer to the media sheet 112 than adjusting fuser lamp temperature.

The controller 140 can also be configured to adjust fuser member settings by adjusting a fuser member rotational speed according to the sensed media sheet exit temperature. If the fuser member rotational speed is adjusted, other transport speeds in the apparatus 100 can be adjusted accordingly to compensate for the adjusted fuser member rotational speed. Additionally, a combination of fuser nip width 123, fuser member temperature, and fuser member rotational speed can be adjusted according to the sensed media sheet exit temperature. For example, various combinations of fuser member settings can be adjusted according to the sensed media sheet exit temperature. If an upper limit of one setting is reached based on the capacity of the apparatus 100, another setting can be adjusted. For example, if a nip width limit is reached, the fuser temperature can be adjusted.

The apparatus 100 can use a setup media sheet that is blank or that has a known image on it, can sense the setup media sheet exit temperature, and can adjust fuser member settings according to the sensed media sheet exit temperature. Also, the apparatus 100 can continue to sense exit temperatures of subsequent media sheets and can continue to adjust fuser member settings according to the sensed exit temperatures of the subsequent media sheets. Thus, one or more exit sensors can provide continuously variable feedback by sensing the media sheet exit temperatures to adjust the fuser member settings. For example, the media sheet exit temperature can be continually sensed and fuser member settings can be continually adjusted on the fly. Multiple media sheet exit temperatures can be continually sensed, such as sheet-by-sheet, and fuser member settings can be continually adjusted on the fly to continually balance the fuser nip 122 to print job requirements, such as requirements based on media type and job content. If settings are adjusted on the fly, the fuser nip 122 can be adjusted relative to prior sensed temperatures and the fuser nip 122 can be constantly adjusted to account for variations in fuser hardness, paper size, paper type, and other variables.

The fuser member settings can be adjusted according to a desired temperature. For example, a desired temperature can be based on a media marking material melting point. The media marking material can be toner, can be ink jet ink, can be solid ink jet ink, or can be any other marking material. Also, the fuser member 120 may be unheated and may use pressure to fuse an image on the media sheet.

Furthermore, a known image on a media sheet or a blank media sheet can be used to calibrate the apparatus 100 by sensing the media sheet temperature and adjusting fuser member settings. Alternately or additionally, a media sheet with an unknown image may be used for sensing and adjusting during normal apparatus setup and/or operation. For example, the amount, color, density, and/or mass of the marking material being laid down on the media sheet 112 can be used along with a look-up table to adjust fuser member setting when an unknown image is used. A look up table can be used with a known or an unknown image based on a type of paper, paper weight, paper size, image type, and/or other factors.

The apparatus 100 can include at least one pre-fuser sensor 138 coupled in proximity to the fuser member 120. The pre-fuser sensor 138 can be configured to sense a pre-fuser temperature of the media sheet 112 prior to the media sheet 112 entering the fuser nip 122. The controller 140 can be coupled to the pre-fuser sensor 138 and can be coupled to the exit sensor 130 and the controller 140 can be configured to adjust fuser member settings according to the sensed exit temperature. The fuser member settings can be adjusted according to a difference between the sensed pre-fuser temperature and the sensed exit temperature, according to an expected difference between the sensed pre-fuser temperature and the sensed exit temperature, according to media sheet size and type, according to print job content, and according to other factors. For example, a look up table or simulation software can be used to determine the expected difference between the media sheet pre-fuser temperature and the media sheet exit temperature based on thermal modeling of the temperature vs. time for various paper weights, based on fuser member dwell time, based on the time from the fuser nip 122 to the exit sensor 130, and/or based on other factors. The fuser dwell time can be the amount of time the media sheet 112 is in contact with the fuser member 120. The amount of energy put into the media sheet 112 to heat the media sheet 112 can be a result of the dwell time where a wider fuser nip can provide more dwell time. Thus, the fuser nip width 123 can be adjusted to obtain more or less dwell time. The media sheet temperature can be continuously monitored to provide for constant adjustment of the fuser nip 122 or the adjustment of the fuser nip 122 can be done as part of an automatic setup routine, which can be done periodically.

Thus, thermal sensors can be used to measure the temperature increase of a media sheet as it passes through a fuser nip. The paper temperature change along with the fuser roll surface temperature can be used as a feedback mechanism to adjust fuser nip settings. The media sheet can be blank, imaged with a known specific image, or imaged with an unknown image. The media sheet can be of a specific type, size, and weight.

For example, non-contact thermal sensors can be used to measure the temperature of a media sheet as it leaves a fuser nip. The sensors can be located after the fuser nip at a known distance and time and can be spaced axially along the media sheet width to provide for size specific or average temperature readings. One or more sensors can also measure the temperature of the media sheet before it enters the fuser nip. The temperature change of the sheet can then be calculated.

For a given nip width and fuser member temperature, light weight sheets warm-up more than heavy weight sheets. The required toner paper interface temperature to give good image permanence can be assumed to be constant for papers with common coatings independent of weight. The temperature of the paper or image surface shortly after the fuser nip can be proportional to the actual toner paper interface temperature. A look up table of the expected temperature rise of the paper can be generated from thermal modeling of temperature vs. time for various paper weights, fuser dwell time, the time from the fuser nip to the temperature sensor, and other factors. Also, such simulations can be performed by the apparatus control software.

The difference between the desired temperature rise of the media sheet and the actual temperature rise can be used as the controlling signal to drive nip width adjustment. A fuser nip can then be dynamically adjusted through a load system by any number of dynamic means, such as variable cams, air cylinders, and other means, to compensate for variations from a desired temperature.

Media sheet temperature can be continuously monitored to provide for constant adjustment of the fuser nip or the adjustment of the fuser nip could be done as part of an automatic setup routine periodically. Because media sheet temperature may be sensitive to toner density and color, temperature monitoring can be done on blank sheets or specially designed image targets and the media sheet can be of a specific type, size, and weight.

The sensed media sheet temperature can be used as feedback to adjust a fuser nip to provide the optimum amount of energy to the fusing process. This feedback can be used for real time adjustment of a nip load system.

Figure 3:
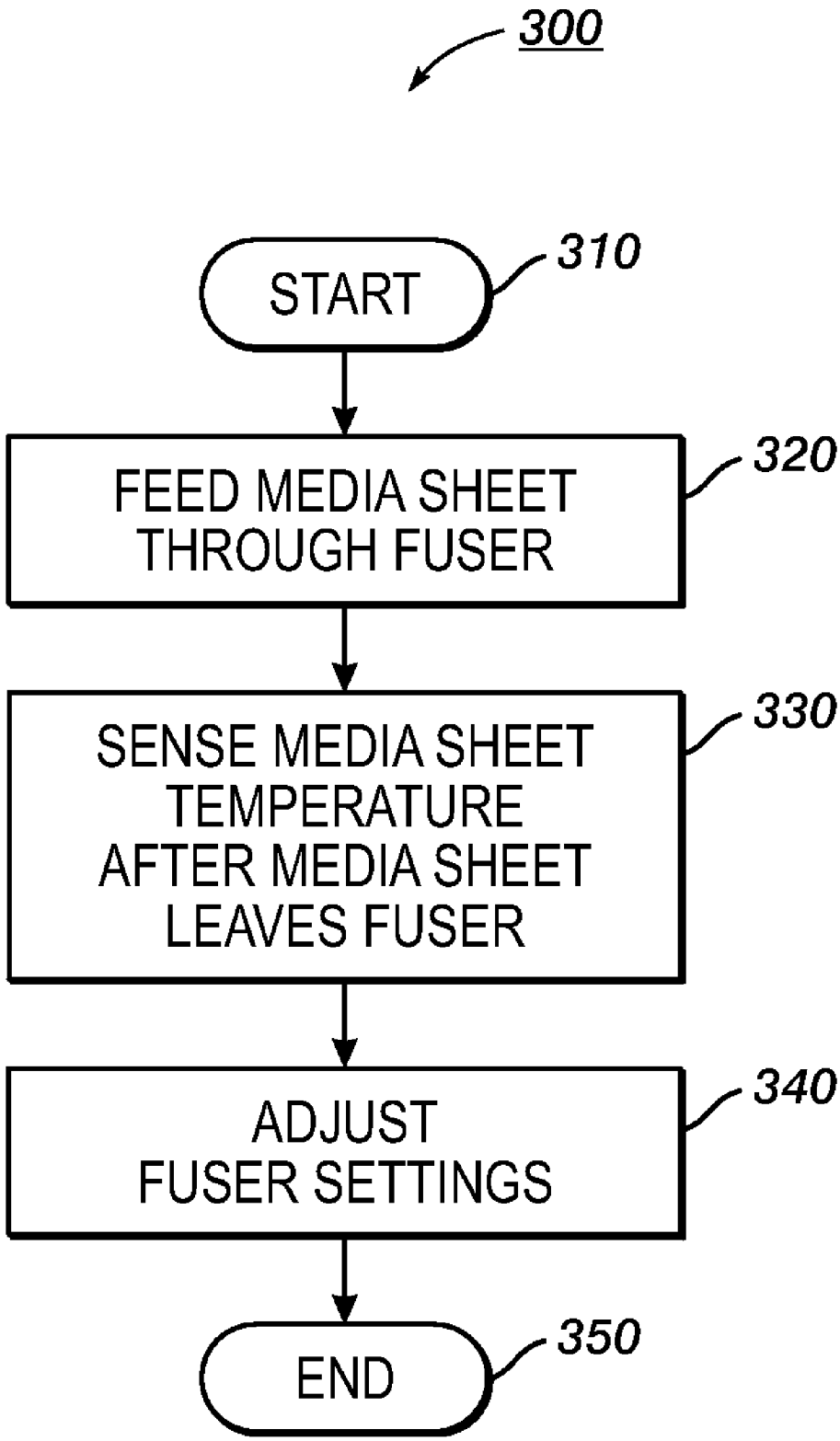
FIG. 3 illustrates an exemplary flowchart of a method of adjusting fuser nip settings.

FIG. 3 illustrates an exemplary flowchart 300 of a method of adjusting fuser nip settings in an apparatus, such as the apparatus 100, including a fuser member having a fuser nip configured to fuse an image on media. The method starts at 310. At 320, a media sheet can be fed in a media sheet travel direction through the fuser nip. At 330, a media sheet exit temperature of the media sheet can be sensed after the media sheet exits the fuser nip. The media sheet exit temperature can be sensed by sensing a plurality of media sheet exit temperatures across a width of the media sheet, where the width of the media sheet is substantially perpendicular to the media sheet travel direction.

At 340, fuser member settings, such as a fuser nip width, can be adjusted according to the sensed media sheet exit temperature. Fuser member settings can be adjusted by adjusting a fuser nip width according to the sensed media sheet exit temperature, where the fuser nip width is substantially parallel to the media sheet travel direction. Fuser member settings can also be adjusted by adjusting fuser member settings according to the sensed plurality of media sheet exit temperatures. Fuser member settings can also be adjusted by adjusting a first fuser nip width at a first position along a length of the fuser according to the plurality of sensed media sheet exit temperatures, the length of the fuser substantially perpendicular to the media sheet travel direction. Fuser member settings can also be adjusted by adjusting a second fuser nip width at a second position along a length of the fuser according to the plurality of sensed media sheet exit temperatures, where the second position is different from the first position. Fuser member settings can also be adjusted by adjusting a fuser member temperature according to the sensed media sheet exit temperature. Fuser member settings can also be adjusted by adjusting a fuser member rotational speed according to the sensed media sheet exit temperature. Fuser member settings can also be adjusted by adjusting fuser member settings according to a desired temperature. The media sheet exit temperature can be continually sensed and fuser member settings can be continually adjusted according to the sensed media sheet exit temperature. At 350, the method ends.

According to a related embodiment, at 320, a media sheet is fed in a media sheet travel direction through the fuser nip. Pressure can be exerted on the media sheet using the fuser nip as the media sheet is fed through the fuser nip. At 330, a media sheet exit temperature of the media sheet can be sensed after the media sheet exits the fuser nip. The media sheet exit temperature can be sensed across a width of the media sheet, where the width of the media sheet is substantially perpendicular to the media sheet travel direction. At 340, a fuser nip width can be adjusted according to the sensed media sheet exit temperature, where the fuser nip width is substantially parallel to the media sheet travel direction. The fuser nip width can be adjusted by adjusting a fuser nip width at different locations across a length of the fuser member according to the sensed media sheet exit temperature, where the length of the fuser member is substantially parallel to the width of the media sheet.

Figure 4:
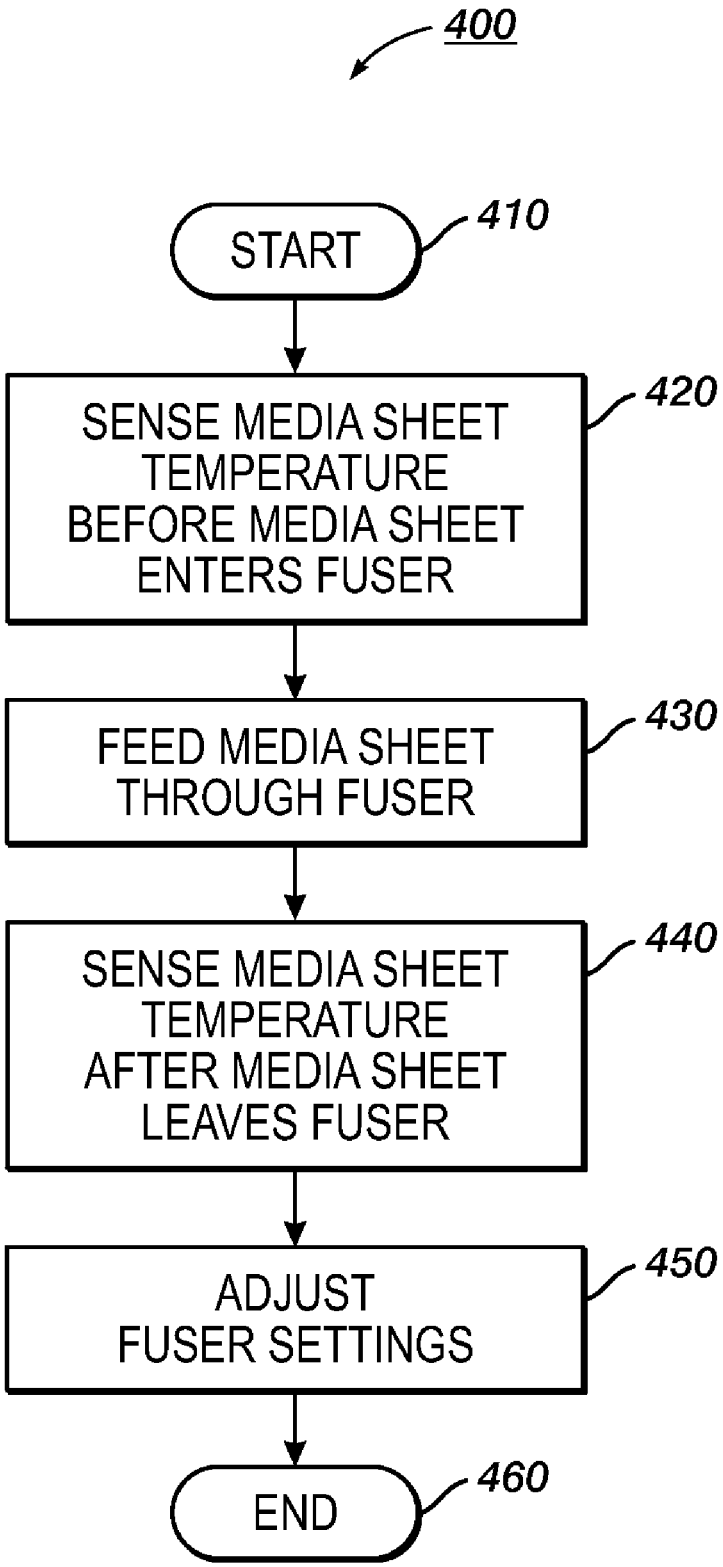
FIG. 4 illustrates an exemplary flowchart of a method of adjusting fuser nip settings.

FIG. 4 illustrates an exemplary flowchart 400 of a method of adjusting fuser nip settings in an apparatus including a fuser member having a fuser nip configured to fuse an image on media. Elements of the flowchart 400 can be combined with elements of the flowchart 300. The method starts at 410. At 420, a pre-fuser temperature of the media sheet can be sensed prior to the media sheet entering the fuser nip. At 430, the media sheet can be fed in a media sheet travel direction through the fuser nip. At 440, a media sheet exit temperature of the media sheet can be sensed after the media sheet exits the fuser nip. At 450, fuser member settings can be adjusted according to a difference between the sensed pre-fuser temperature and the sensed exit temperature and according to an expected difference between the sensed pre-fuser temperature and the sensed exit temperature. Fuser member settings can also be adjusted according to a difference between the sensed pre-fuser temperature and the sensed exit temperature, according to media sheet size and type, according to print job content, and according to other factors. At 460, the method ends.

Thus, embodiments can measure the surface temperature across width of a media sheet and can infer, from the measurement, the fuser nip settings across the width of the media sheet. The fuser nip can be adjusted accordingly based on the measurement. A known media size and type can be specified through a media library definition within a user interface so a printer can know the media size and weight, and a look-up table can be used to determine appropriate fuser nip settings. Job content information, such as the amount of marking material being put down, can be used, the marking material density can be known, and the amount of thermal input can be inferred accordingly to adjust the fuser nip settings.

Figure 5:
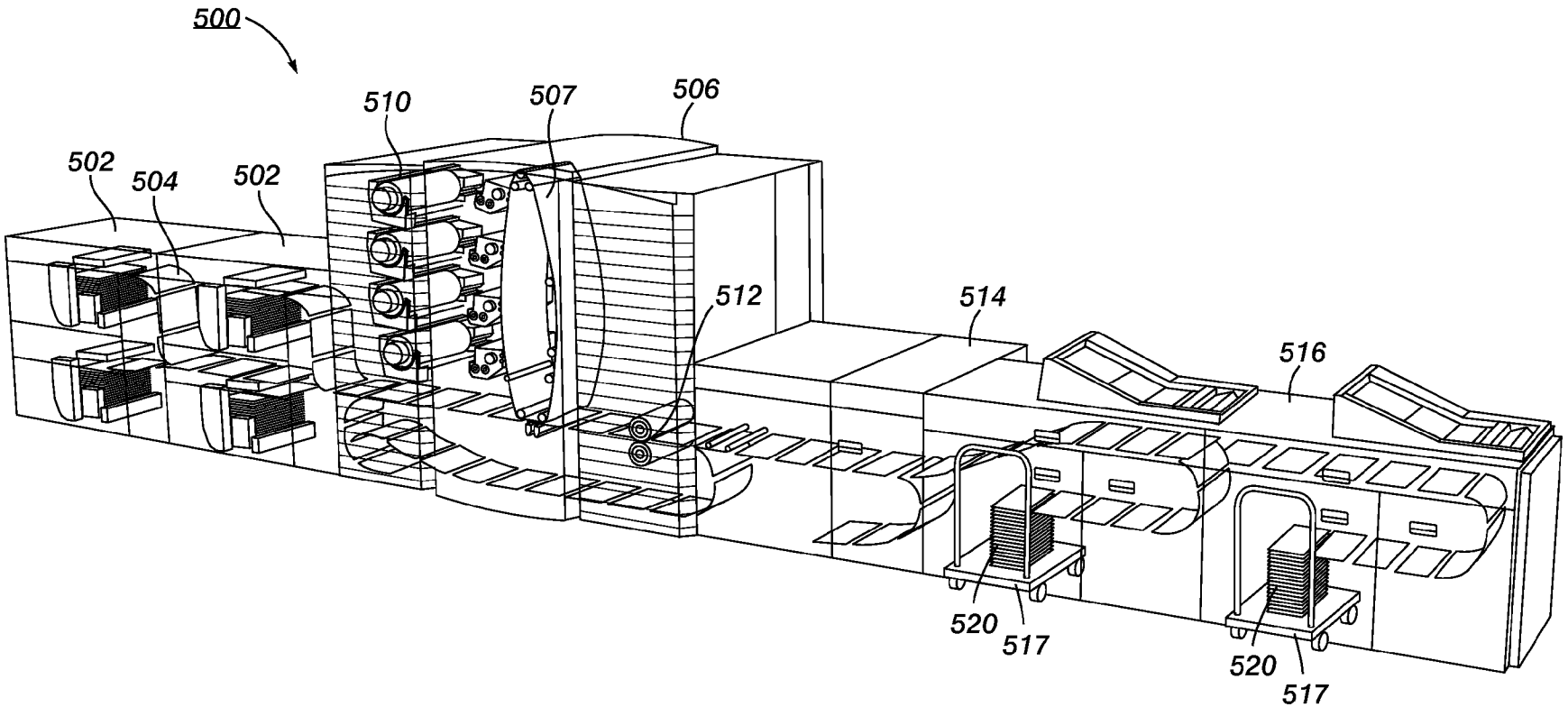
FIG. 5 illustrates an exemplary printing apparatus.

FIG. 5 illustrates an exemplary printing apparatus 500, such as the apparatus 100. As used herein, the term "printing apparatus" encompasses any apparatus, such as a printer, a digital copier, a bookmaking machine, a multifunction machine, and other printing devices that perform a print outputting function for any purpose. The printing apparatus 500 can be used to produce prints from various media, such as coated, uncoated, previously marked, or plain paper sheets. The media can have various sizes and weights. In some embodiments, the printing apparatus 500 can have a modular construction. The printing apparatus 500 can include at least one media feeder module 502, a printer module 506 adjacent the media feeder module 502, an inverter module 514 adjacent the printer module 506, and at least one stacker module 516 adjacent the inverter module 514.

In the printing apparatus 500, the media feeder module 502 can be adapted to feed media 504 having various sizes, widths, lengths, and weights to the printer module 506. In the printer module 506, toner is transferred from an arrangement of developer stations 510 to a charged photoreceptor belt 507 to form toner images on the photoreceptor belt 507. The toner images are transferred to the media 504 fed through a paper path. The media 504 are advanced through a fuser 512 adapted to fuse the toner images on the media 504. The inverter module 514 manipulates the media 504 exiting the printer module 506 by either passing the media 504 through to the stacker module 516, or by inverting and returning the media 504 to the printer module 506. In the stacker module 516, printed media are loaded onto stacker carts 517 to form stacks 520.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Embodiments can provide for more precise control of fuser nip width settings. Embodiments can provide for nip width control relative to media size and type as well as print job content. Embodiments can provide for holding the fuser temperature at a minimum reasonable level and can provide for fast adjustments of fuser load based on media sheet weight. Embodiments can provide for reduced thermal energy applied to the paper, which can reduce machine power usage and reduce excess temperature. Embodiments can also provide for reduced roll wear by continually adjusting the fuser nip width to the optimal value as the roll hardness and as paper width, paper thickness, and other variables change. Embodiments can provide for minimizing fix and gloss variations by maintaining optimum energy to the media sheet as the factors mentioned above vary.

Some embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in an apparatus including a fuser member having a fuser nip configured to fuse an image on media, the method comprising:

feeding a media sheet in a media sheet travel direction through the fuser nip;

sensing a media sheet exit temperature of the media sheet after the media sheet exits the fuser nip; and adjusting a fuser member nip width according to the sensed media sheet exit temperature, where the fuser nip width is substantially parallel to the media sheet travel direction.

2. The method according to claim 1, wherein sensing a media sheet exit temperature comprises sensing a plurality of media sheet exit temperatures across a width of the media sheet, the width of the media sheet being substantially perpendicular to the media sheet travel direction, and wherein adjusting a fuser member nip width comprises adjusting fuser member settings according to the sensed plurality of media sheet exit temperatures.

3. The method according to claim 2, wherein adjusting a fuser member nip width comprises adjusting a first fuser nip width at a first position along a length of the fuser according to the plurality of sensed media sheet exit temperatures, the length of the fuser substantially perpendicular to the media sheet travel direction, and wherein adjusting a fuser member nip width comprises adjusting a second fuser nip width at a second position along a length of the fuser according to the plurality of sensed media sheet exit temperatures, where the second position is different from the first position.

4. The method according to claim 1, wherein adjusting further comprises adjusting a fuser member temperature according to the sensed media sheet exit temperature.

5. The method according to claim 1, wherein adjusting further comprises adjusting a fuser member rotational speed according to the sensed media sheet exit temperature.

6. The method according to claim 1, further comprising continuing to sense the media sheet exit temperature and continuing to adjust the fuser member nip width according to the sensed media sheet exit temperature.

7. The method according to claim 1, wherein adjusting a fuser member nip width comprises adjusting fuser member settings according to a desired temperature.

8. The method according to claim 1, further comprising sensing a pre-fuser temperature of the media sheet prior to the media sheet entering the fuser nip.

9. The method according to claim 8, wherein adjusting a fuser member nip width comprises adjusting the fuser member nip width according to a difference between the sensed pre-fuser temperature and the sensed exit temperature and according to an expected difference between the sensed pre-fuser temperature and the sensed exit temperature.

10. The method according to claim 8, wherein adjusting a fuser member nip width comprises adjusting the fuser member nip width according to a difference between the sensed pre-fuser temperature and the sensed exit temperature, according to media sheet size and type, and according to print job content.

11. An apparatus comprising:

a media transport configured to transport a media sheet;

a fuser member coupled to the media transport, the fuser member having a fuser nip configured to fuse an image on media;

an exit sensor coupled in proximity to the fuser member, the exit sensor configured to sense an exit temperature of the media sheet after the media sheet exits the fuser nip; and a controller coupled to the exit sensor and coupled to the fuser member, the controller configured to adjust a fuser member nip width according to the sensed exit temperature.

12. The apparatus according to claim 11, wherein the controller is configured to adjust a fuser member nip width according to the sensed exit temperature, according to media sheet size and type, and according to print job content.

13. The apparatus according to claim 11, wherein the fuser member comprises a rotational fuser member rotationally supported in the apparatus and a rotational pressure member rotationally supported in the apparatus, the rotational pressure member configured to exert pressure against the rotational fuser member at the fuser nip.

14. The apparatus according to claim 11, wherein the controller is configured to adjust a fuser member nip width by adjusting the fuser nip width according to the sensed media sheet exit temperature, where the fuser nip width is substantially parallel to the media sheet travel direction.

15. The apparatus according to claim 11, wherein the exit sensor comprises a plurality of exit sensors configured to sense a plurality of media sheet exit temperatures across a width of the media sheet, the width of the media sheet being substantially perpendicular to the media sheet travel direction, and wherein the controller is configured to adjust the fuser member nip width according to the plurality of sensed media sheet exit temperatures.

16. The apparatus according to claim 15, wherein the controller is configured to adjust a fuser member nip width by adjusting a first fuser nip width at a first position along a length of the fuser according to the plurality of sensed media sheet exit temperatures, the length of the fuser substantially perpendicular to the media sheet travel direction, and wherein the controller is configured to adjust a fuser member nip width by adjusting a second fuser nip width at a second position along a length of the fuser according to the plurality of sensed media sheet exit temperatures, where the second position is different from the first position.

17. The apparatus according to claim 11, wherein the controller is configured to adjust at least one of a fuser member temperature and a fuser member rotational speed according to the sensed media sheet exit temperature.

18. The apparatus according to claim 11, further comprising a pre-fuser sensor coupled in proximity to the fuser member, the pre-fuser sensor configured to sense a pre-fuser temperature of the media sheet prior to the media sheet entering the fuser nip, wherein the controller is coupled to the pre-fuser sensor and coupled to the exit sensor and the controller is configured to adjust a fuser member nip width according to the sensed pre-fuser temperature and according to the sensed exit temperature.

19. A method in an apparatus including a fuser member having a fuser nip configured to fuse an image on media, the method comprising:

feeding a media sheet in a media sheet travel direction through the fuser nip;

exerting pressure on the media sheet using the fuser nip;

sensing a media sheet exit temperature of the media sheet after the media sheet exits the fuser nip; and adjusting a fuser nip width according to the sensed media sheet exit temperature, where the fuser nip width is substantially parallel to the media sheet travel direction.

20. The method according to claim 19, wherein sensing a media sheet exit temperature comprises sensing the media sheet exit temperature across a width of the media sheet, the width of the media sheet being substantially perpendicular to the media sheet travel direction, and wherein adjusting a fuser nip width comprises adjusting a fuser nip width across a length of the fuser member according to the sensed media sheet exit temperature, the length of the fuser member being substantially parallel to the width of the media sheet.

* * * * *